US006624574B1

(12) United States Patent
Cho et al.

(10) Patent No.: US 6,624,574 B1
(45) Date of Patent: Sep. 23, 2003

(54) ELECTRODE FOR PLASMA DISPLAY PANEL AND METHOD FOR MANUFACTURING THE SAME

(75) Inventors: Jung Soo Cho, Pusan-si (KR); Chung Hoo Park, Pusan-si (KR); Ki En Lee, Kumi-si (KR); Jae Hyun Ko, Kunpo-si (KR); Jae Hwa Ryu, Kumi-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/378,575

(22) Filed: Aug. 20, 1999

Related U.S. Application Data

(62) Division of application No. 08/829,824, filed on Mar. 25, 1997, now Pat. No. 5,971,824.

(30) Foreign Application Priority Data

Apr. 25, 1996 (KR) ..... 96/12931

(51) Int. Cl.[7] ..... H01J 17/49; H01J 17/04

(52) U.S. Cl. ..... 313/582; 313/491; 313/583

(58) Field of Search ..... 313/582, 583, 313/584, 586, 587, 326, 491, 574; 349/147, 143; 445/24, 50

(56) References Cited

U.S. PATENT DOCUMENTS

| | | | | |
|---|---|---|---|---|
| 4,000,983 A | | 1/1977 | Alexandrov et al. | |
| 4,234,814 A | | 11/1980 | Chen et al. | 313/412 |
| 4,242,613 A | | 12/1980 | Boamboing et al. | 313/447 |
| 4,254,546 A | * | 3/1981 | Ullery, Jr. | 252/513 |
| 4,358,703 A | | 11/1982 | Bijana et al. | 313/448 |
| 4,454,449 A | * | 6/1984 | Hall | 313/584 |

(List continued on next page.)

FOREIGN PATENT DOCUMENTS

| | | | | |
|---|---|---|---|---|
| DE | 44 31 386 A1 | | 6/1996 | |
| JP | 55-102155 | | 8/1980 | |
| JP | 63-232240 | | 9/1988 | |
| JP | 4-33099 | | 4/1992 | |
| JP | 5-258682 | | 8/1993 | |
| JP | 6-162956 | | 6/1994 | |
| JP | 07-085797 | | 3/1995 | |
| JP | 11317161 A | * | 11/1999 | H01J/9/02 |
| WO | WO 95/00969 | | 1/1995 | |

OTHER PUBLICATIONS

Patent Abstracts of Japan, vol. 18, No. 458, Aug. 25, 1994 (JP 06 150855—Aug. 5, 1980).

"14:3 New Approach to Design Dynamic Quadrupole Inline Gun for CRT", B.K. Song, H.t. Kim S.K., Euro Display '96, pp. 500–503 +Euro Display Itinerary Proceedings of the 16$^{th}$ Intern'tl Display Research Conference (Oct. 1996).

English language abstract of JP04–345734.

English language abstract of JP51–134564.

English language abstract of JP52–70751.

English language abstract of JP54–73555.

English language abstract of JP05–263229.

*Primary Examiner*—Nimeshkumar D. Patel
*Assistant Examiner*—Karabi Guharay
(74) *Attorney, Agent, or Firm*—Birch, Stewart, Kolasch & Birch, LLP

(57) ABSTRACT

An electrode for a plasma display panel (PDP) in which an electrode having a high adhesive power is formed on a glass substrate of a color plasma display panel and a method for forming the same. The electrode for the PDP includes a metal ceramic thin film formed between a metal electrode and a dielectric substrate. The method includes steps of forming a metal ceramic thin film on a predetermined portion of the dielectric substrate and forming an electrode having the same metal element as the metal ceramic thin film on the metal ceramic thin film.

5 Claims, 4 Drawing Sheets

U.S. PATENT DOCUMENTS

| | | | | | |
|---|---|---|---|---|---|
| 4,523,123 | A | | 6/1985 | Chen | 313/412 |
| 4,558,253 | A | | 12/1985 | Bechis et al. | 313/414 |
| 4,599,534 | A | | 7/1986 | Shirai et al. | 313/414 |
| 4,608,515 | A | | 8/1986 | Chen | 313/412 |
| 4,629,933 | A | | 12/1986 | Bijana et al. | 313/414 |
| 4,772,826 | A | | 9/1988 | Bloom et al. | 315/382 |
| 4,825,121 | A | | 4/1989 | Miyazaki | 313/414 |
| 4,877,998 | A | | 10/1989 | Maninger et al. | 315/15 |
| 4,886,999 | A | | 12/1989 | Yamane et al. | 313/414 |
| 4,887,009 | A | | 12/1989 | Bloom et al. | 315/368 |
| 4,891,549 | A | | 1/1990 | Kniesser et al. | 313/414 |
| 5,015,911 | A | | 5/1991 | Cho | 313/414 |
| 5,023,508 | A | | 6/1991 | Park | 313/414 |
| 5,034,653 | A | | 7/1991 | Cho et al. | 313/414 |
| 5,066,887 | A | | 11/1991 | New | 313/414 |
| 5,142,189 | A | | 8/1992 | Sugahara et al. | 313/414 |
| 5,146,133 | A | | 9/1992 | Shirai et al. | 313/414 |
| 5,164,640 | A | | 11/1992 | Son et al. | 315/382 |
| 5,177,400 | A | * | 1/1993 | Iwasaki | 313/112 |
| 5,198,719 | A | | 3/1993 | Koh | 313/414 |
| 5,212,423 | A | | 5/1993 | Noguchi et al. | 313/414 |
| 5,300,854 | A | | 4/1994 | Kweon | 313/414 |
| 5,300,855 | A | | 4/1994 | Kweon | 313/414 |
| 5,347,202 | A | | 9/1994 | Stil | 313/414 |
| 5,384,512 | A | | 1/1995 | Komohara et al. | 313/414 |
| 5,404,071 | A | | 4/1995 | Son | 313/414 |
| 5,412,277 | A | | 5/1995 | Chen | 313/414 |
| 5,414,323 | A | | 5/1995 | Uchida et al. | 313/414 |
| 5,418,421 | A | | 5/1995 | Hasegawa et al. | 313/412 |
| 5,430,349 | A | | 7/1995 | New et al. | 313/412 |
| 5,449,983 | A | | 9/1995 | Sugawara et al. | 315/382 |
| 5,451,834 | A | | 9/1995 | Dho et al. | 313/414 |
| 5,488,265 | A | | 1/1996 | Chen | 313/414 |
| 5,506,468 | A | | 4/1996 | Koh | 313/414 |
| 5,512,797 | A | | 4/1996 | Kim et al. | 313/414 |
| 5,539,285 | A | | 7/1996 | Iguchi et al. | 315/382 |
| 5,572,085 | A | | 11/1996 | Choi | 313/414 |
| 5,719,475 | A | | 2/1998 | Shishido | 315/368.15 |
| 5,763,993 | A | | 6/1998 | Park et al. | 313/414 |
| 5,770,921 | A | * | 6/1998 | Aoki et al. | 313/572 |
| 5,814,929 | A | | 9/1998 | Jo | 313/414 |
| 5,869,925 | A | | 2/1999 | Kim et al. | 313/460 |
| 5,900,694 | A | * | 5/1999 | Matsuzaki et al. | 313/484 |
| 6,208,400 | B1 | * | 3/2001 | Kameyama et al. | 349/147 |
| 6,219,125 | B1 | * | 4/2001 | Ishikura et al. | 349/147 |
| 6,410,214 | B1 | * | 6/2002 | Kim | 427/304 |
| 6,452,331 | B1 | * | 9/2002 | Sakurada et al. | 313/582 |

* cited by examiner

ELECTRODE FOR PLASMA DISPLAY PANEL AND METHOD FOR MANUFACTURING THE SAME

RELATED APPLICATION(S)

This is a divisional application of U.S. application Ser. No. 08/829,824, filed Mar. 25, 1997 and issued on Oct. 26, 1999 as U.S. Pat. No. 5,971,824, the entirety of which is hereby incorporated by reference.

BACKGROUND OF THE INVENTION

1. Field of the Invention

The present invention relates to an electrode for a plasma display panel (PDP) in which an electrode having high adhesive power is formed on a glass substrate of a color plasma display panel and a method for forming the same.

2. Discussion of the Related Art

FIG. 1 is a cross-sectional view showing a structure of a conventional PDP.

First, a pair of upper electrodes are formed on a front glass substrate 1, as shown in FIG. 1. Next, a dielectric layer 2 is formed over the pair of the upper electrodes 4 by employing a printing method and a protecting layer 3 is formed on the dielectric layer 2 by a deposition method. The pair of upper electrodes 4, the dielectric layer 2 and the protecting layer 3 constitute the upper structure.

Secondly, on a back glass substrate 11, there is formed a lower electrode 12. Sidewalls 6 are formed in order to prevent crosstalk between the cell and an adjacent cell. Luminescent materials 8, 9 and 10 are formed on both sides of each of the sidewalls and on the back glass substrate 11. The lower electrode 12, the sidewalls 6, and the luminescent materials 8, 9, and 10 constitute the lower structure. A non-active gas fills the space between the upper electrode 4 and the lower electrode 12 such that a discharge region 5 is formed.

The operation of a general PDP will be explained.

Referring to FIG. 1, a driving voltage is applied to the pair of upper electrodes so that a surface discharge is generated in the discharge region 5, thereby generating ultraviolet light 7. The ultraviolet light 7 excites the luminescent materials 8, 9 and 10, thusachieving color display. In other words, the space charge which is present in the discharge cell moves to the cathode due to the driving voltage. The space charge collides with non-active mixed gas which is a penning mixed gas added to by xenon (Xe), neon (Ne) and (He) helium (which is the main component of the mixed gas), such that the non-active gas is excited and ultraviolet light 7 of 147 nm is thus generated. Herein, when the non-active gas fills the discharge cell, its pressure is 400–500 torr.

The ultraviolet light collides with the luminescent material 8, 9 and 10 on the sidewalls 6 and the back glass substrate 11, thus forming a visible ray region.

A conventional electrode of a PDP and a method for forming the same will be discussed with the accompanying drawings.

FIGS. 2*a* and 2*b* are cross-sectional views showing upper and lower substrates of a PDP according to a conventional method.

As shown in FIG. 2*a*, for the lower substrate, a metal conductive material 30 such as nickel (Ni) or aluminum (Al) is formed on a back glass subtrate 11 (dielectric substrate) by means of a printing technique. As shown in FIG. 2*b*, for the upper substrate, copper (Cu) 35 used as an electrode is formed in a front glass substrate (dielectric substrate) (1).

Cu, Ni, and Al have all a very low interfacial with respect to glass. Thus, a chromium (Cr) layer 40 is formed between the glass surface and Cu 35, or between the glass surface and Al 30 or Ni in order to maintain adhesion between the glass and the Cu 35, or between the glass surface and the Al 30 or the Ni.

Referring to the forming process, a Cr thin film 40 is formed on the front glass substrate 1 of the PDP by means of a sputtering method in order to improve the interfacial coherence. Then a Cu film (35) used as an electrode is formed on the Cr thin film 40. Next, another Cr thin film 40 is formed on the Cu film 35 in the same sputtering method in order to improve the interfacial coherence. Finally, employing annealing, a glass is used to cover the entire surface of the front glass substrate 1 inclusive of the Cu film 35 and the Cr thin films 40.

Like the glass substrate, a dielectric substrate is applied in the same manner as the glass substrate. Similarly, in the same manner, the electrode on the front glass substrate 11 shown in FIG. 2*a* is formed.

A conventional electrode of a PDP and a forming method thereof have the following disadvantages.

Since Cr is a pure metal, Cr has a poor interfacial coherence with respect to glass. Besides, in case glass is annealed at a high temperature, interfacial cracks or foam are generated at the interface of the glass and the Cr due to their different rates of expansion, and thus the discharge of the PDP becomes unstable and the life span of the PDP becomes shortened. Moreover, since the coupling is made between two different metals (Cu and Cr) that is, an electrode and an interfacial adhesives a sputtering process is carried out for the Cu and a separate sputtering process is carried out for the Cr. Accordingly, the overall process is complicated.

SUMMARY OF THE INVENTION

Therefore, the present invention is directed to an electrode of a plasma display panel (PDP) that substantially obviates one or more problems due to limitations and disadvantages of the related art.

An object of the invention is to provide an electrode of a plasma display panel (PDP) in which, on a glass substrate of a color plasma display panel, there is formed an electrode having a high adhesive power for improving a discharge condition of a PDP and its life span and a forming method thereof.

Additional features and advantages of the invention will be apparent from the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electrode of a PDP in which a metal electrode is formed on a dielectric substrate includes a metal ceramic thin film formed between the metal electrode and the dielectric substrate or a glass substrate.

In another aspect, a method for forming an electrode of a PDP in which a dielectric substrate and a metal electrode are formed includes the steps of forming a metal ceramic thin film on a predetermined portion of the dielectric substrate; and forming an electrode having the same metal element as the metal ceramic thin film on the metal ceramic thin film.

It is to be understood that both the foregoing general description and the following detailed description are exemplary and explanatory and are intended to provide further explanation of the invention as claimed.

BRIEF DESCRIPTION OF THE DRAWINGS

These and other objects, features, and advantages of the present invention will be readily understood with reference to the following detailed description read in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
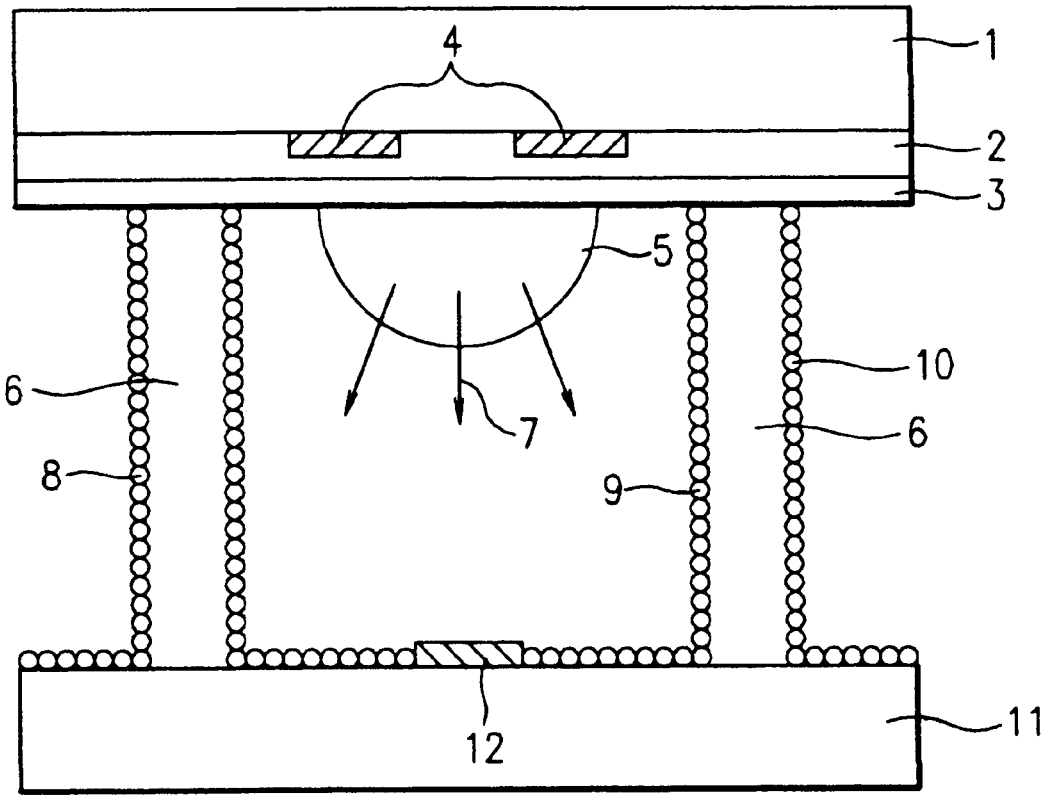
FIG.1 conventional art
FIG. 1 is a cross-sectional view showing a structure of a conventional PDP.
Figure 2A:
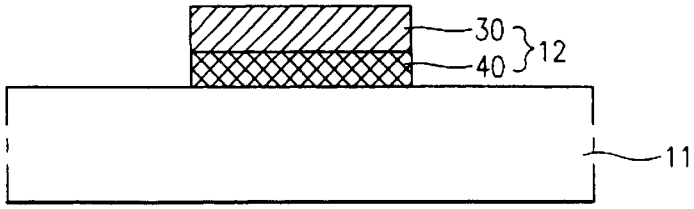
FIG.2a conventional art
FIG. 2*a* is a cross-sectional view showing a conventional electrode formed on a lower substrate of a PDP.
Figure 2B:
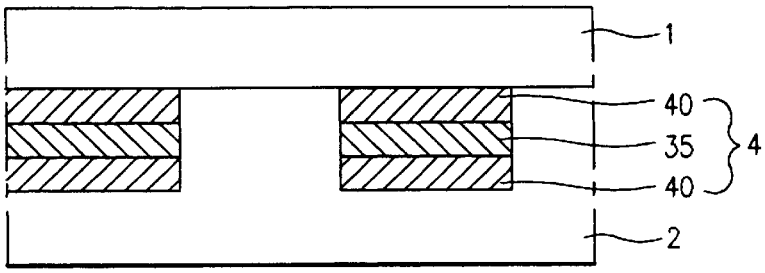
FIG.2b conventional art
FIG. 2*b* is a cross-sectional view showing a conventional electrode formed on an upper substrate of a PDP.
Figure 3A:
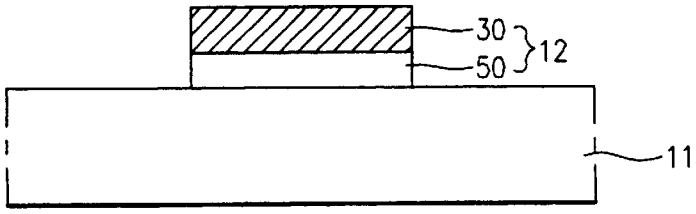
FIG. 3*a* is a cross-sectional view showing an electrode formed on a lower substrate of a PDP according to a preferred embodiment of the invention.
Figure 3B:
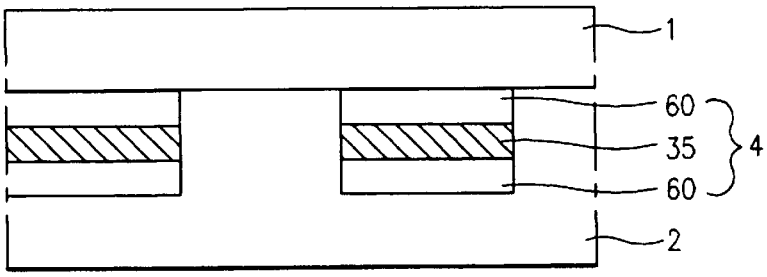
FIG. 3*b* is a cross-sectional view showing an electrode formed on an upper substrate of a PDP according to the preferred embodiment of the invention.

FIGS. 3*a* and 3*b* are cross-sectional views showing electrodes formed on lower and upper substrates, respectively.

In a PDP where a metal electrode is formed on a glass substrate or a dielectric substrate, a metal ceramic thin film having the same element as the metal electrode is formed in order to heighten the interfacial coherence between the metal electrode and the glass substrate or a dielectric substrate.

As shown in FIGS. 3*a* and 3*b,* a metal ceramic thin film, which is an interfacial adhesives, is formed between the back glass substrate dielectric substrate 11 and the lower electrode 12 or between the front glass substrate 1 and the upper electrode 4.

Referring to FIG. 3*a,* before a metal conductive material such as Ni or Al (30) used as an electrode is deposited on the back glass substrate 11 by employing a printing method, a metal ceramic thin film, e.g. a nitride aluminum ($Al_xN$) ceramic thin film or an oxide aluminim ($Al_xO$) ceramic thin film 50 is formed by a reactive sputtering method. Therefore the metal ceramic thin film is either a metal nitride ceramic thin film formed by nitrating of the metal electrode, or a metal oxide ceramic thin film formed by oxidation of the metal electrode.

Referring to FIG. 3*b*, Cu 35 used as electrodes is formed over the front glass substrate 1 (or dielectric substrate). In this case, before the formation of the Cu film 35 used as the electrodes, either copper nitride ($Cu_xN$) ceramic thin film or an oxide aluminum ($Al_xO$) ceramic thin film 60 which has the same element as the film 35 is formed to have a thickness of thousands of Angstroms by employing a reactive sputtering method. Then the Cu film 35 is formed on the ceramic thin film 60. Next, another ceramic thin film 60 is formed on the Cu film 35.

To explain the above-discussed process in more detail, in case a metal is formed to be used as electrodes, before a Cu film 35 is formed on the glass substrate 1, a copper nitride ($Cu_xN$) ceramic thin film 60 is formed on the glass substrate 1 by employing a reactive sputtering method. Alternatively, a copper oxide (CuxO) ceramic thin film 60 is formed on the glass substrate 1 by employing the same sputtering method.

Thus, the reactive sputtering process is carried out only once on one metal, i.e., Cu. In other words, a sputtering is applied to the Cu metal over a predetermined region of the glass substrate. Next, argon (Ar) and nitrogen (N) are injected in a predetermined ratio, or argon and oxygen (O) are injected to carry out the reactive sputtering, thereby forming the copper nitride ceramic thin film or the copper oxide ceramic thin film 60. Thereafter, if argon is injected, or if reactive sputtering is subjected to only copper, the copper metal layer 35 is formed.

Subsequently, argon and nitrogen are injected again in a predetermined ratio after a predetermined time, or argon and oxygen are injected appropriately to carry out another sputtering process so that a copper nitride ceramic thin film or a copper oxide ceramic thin film 60 is formed on the copper metal layer 35, thereby forming an electrode of a PDP.

The conditions of the reactive sputtering are as follows:

Driving pressure: 10 m Torr

Discharge voltage: 450 V

Discharge current: 100 mA

Ratio of the reactive gases ($N_2$/Ar): 15% or more

Deposition time: 10–20 minutes

Substrate bias voltage: −100 V or less

Figure 4A:
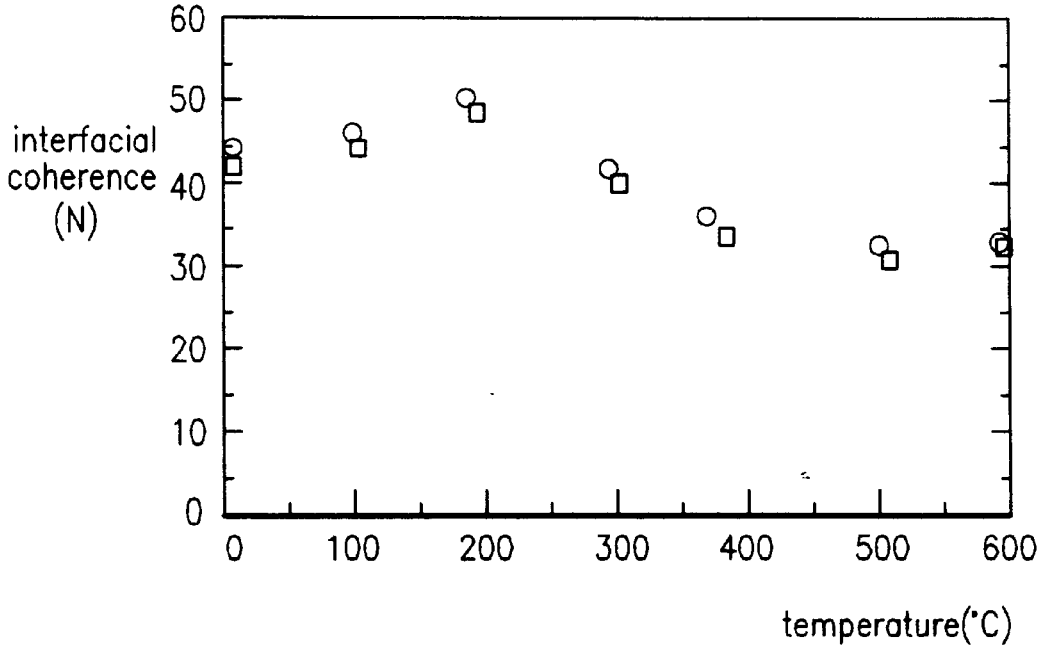
FIG. 4*a* is a graph showing interfacial coherence with respect to temperatures according to the invention.
Figure 4B:
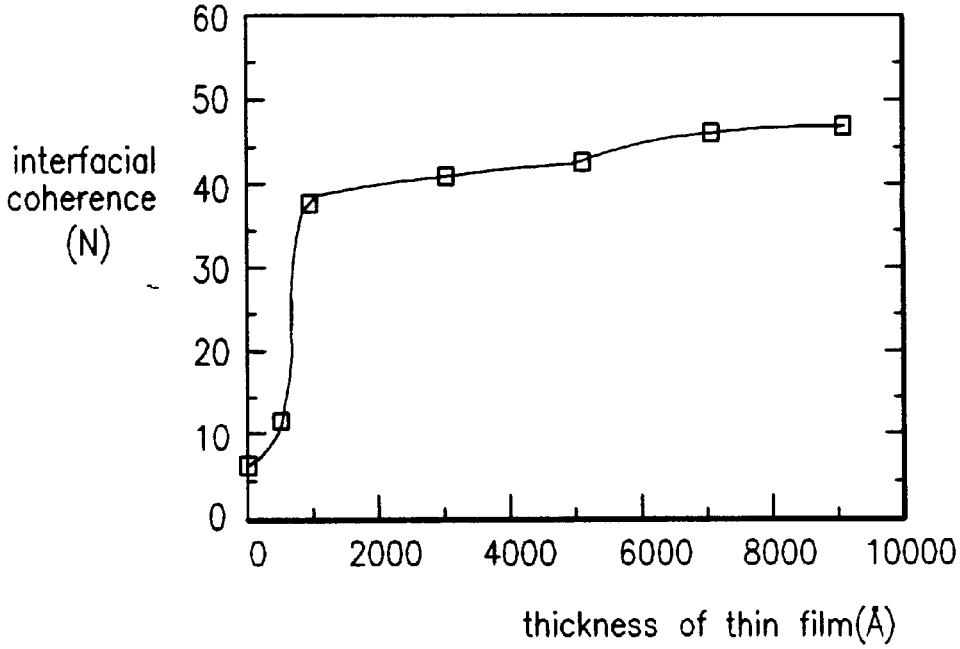
FIG. 4*b* is a graph showing interfacial coherence with respect to thicknesses of a ceramic thin film.
Figure 4C:
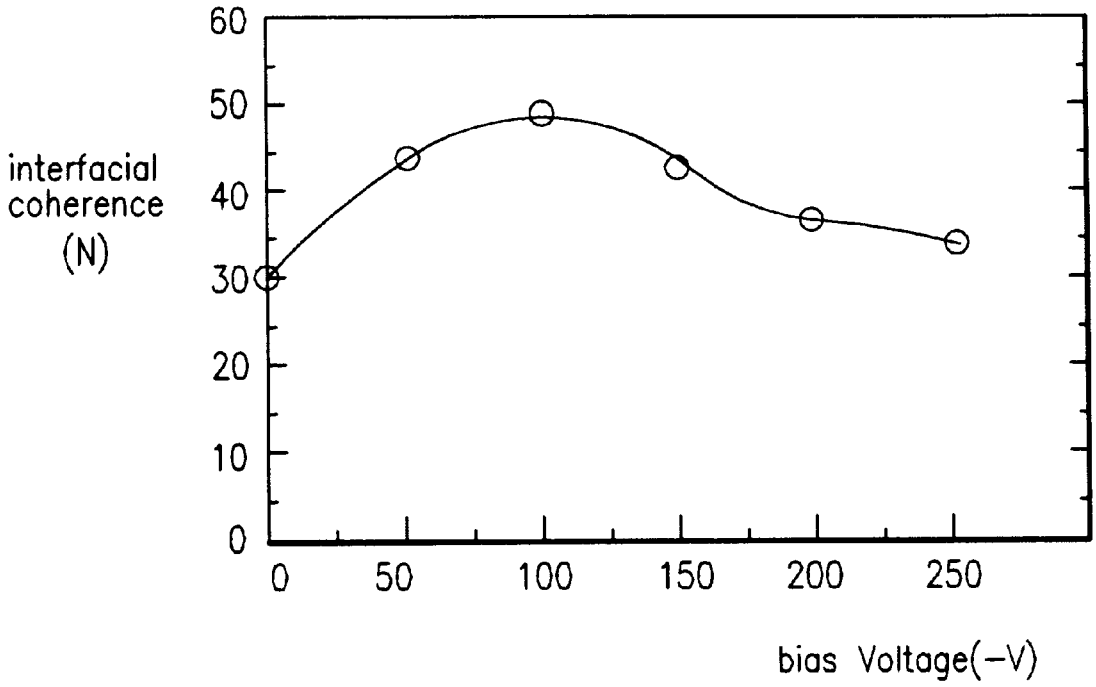
FIG. 4*c* is a graph showing interfacial coherence with respect to bias voltages.

As shown in FIGS. 4*a* through 4*c*, when the process is performed under the above-described conditions, the adhesive power is very good with regard to temperature, thickness of the ceramic thin film, and bias voltage. This process is applied to the front glass substrate 11, as well.

The operation of a PDP formed by the above-described process is the same as that of a general PDP.

The electrode of a PDP and the manufacturing method thereof have the following advantages.

Since the electrode of the PDP has a structure of metal ceramic thin film/metal/metal ceramic thin film, the interfacial adhesive power between the metals is improved, and interfacial flaking, interfacial crack, or interfacial foam is not generated when annealing is performed. Thus, discharge characteristics are improved, and the life span of a PDP is prolonged. Moreover, since a metal for interfacial adhesiveness is the same metal as a metal for an electrode when sputtering is carried out, or since only the mode of the reactive gas is changed, the process of forming a metal ceramic thin film is simplified and the overall process of manufacturing a PDP is significantly simplified.

It will be apparent to those skilled in the art that various modification and variations can be made in the electrode of a plasma display panel (PDP) of the present invention without departing from the spirit or scope of the inventions. Thus, it is intended that the present invention cover the modifications and variations of this invention provided they come within the scope of the appended claims and their equivalents.

What is claimed is:

1. An electrode in a plasma display panel (PDP) in which a metal electrode is formed on a glass substrate, the electrode comprising:

a metal ceramic thin film formed between a single layered metal electrode and the glass substrate in said plasma display panel.

2. The electrode for the PDP as claimed in claim 1, wherein said metal ceramic thin film is formed of a chemical compound including the same metal element as the metal electrode.

3. The electrode for the PDP as claimed in claim 1, wherein said metal ceramic thin film is either a metal oxide ceramic thin film or a metal nitride ceramic thin film.

4. The electrode for the PDP as claimed in claim 1, wherein said metal electrode is made of either copper (Cu) or aluminum (Al).

5. An electrode in a plasma display panel (PDP) in which a metal electrode is formed on a glass substrate, the electrode comprising:

a first ceramic thin film formed between a single layered metal electrode and the glass substrate; and a second ceramic thin film formed between said single layered metal electrode and a dielectric in said plasma display panel.

* * * * *